United States Patent [19]

DuBois

[11] Patent Number: 4,500,087

[45] Date of Patent: Feb. 19, 1985

[54] DROP TRAY SORTER

[75] Inventor: R. Clark DuBois, Fairfield, Conn.

[73] Assignee: Gradco Systems, Inc., Santa Ana, Calif.

[21] Appl. No.: 458,581

[22] Filed: Jan. 17, 1983

[51] Int. Cl.[3] ..... B65H 39/11

[52] U.S. Cl. ..... 271/293; 271/294

[58] Field of Search ..... 271/292, 293, 294, 296, 271/122, 188, 287, 288

[56] References Cited

U.S. PATENT DOCUMENTS

| | | | |
|---|---|---|---|
| 197,477 | 11/1877 | Kneeland | 271/188 |
| 2,093,992 | 9/1937 | Braam | 271/294 |
| 2,589,676 | 3/1952 | Crissy | 271/293 |
| 4,203,587 | 5/1980 | Kishi et al. | 271/293 |
| 4,253,656 | 3/1981 | Landa | 271/293 |
| 4,332,377 | 6/1982 | DuBois et al. | 271/293 |
| 4,433,837 | 2/1984 | Romanowski | 271/293 |

OTHER PUBLICATIONS

Clarkson S. et al., "Sheet Sorter", Xerox Disclosure Journal, vol. 1, No. 4, Apr. 1976, p. 59.

*Primary Examiner*—Bruce H. Stoner, Jr.
*Assistant Examiner*—James E. Barlow
*Attorney, Agent, or Firm*—Newton H. Lee, Jr.

[57] ABSTRACT

In the present invention, a sheet-sorter, operating in conjunction with a photocopy machine, has a plurality of trays in general horizontal alignment with the path taken by a sheet of paper discharged from the copier. A tray pusher is arranged to move the lower-most tray in a stack of trays disposed above the paper-path so that the in-board end of the lower-most tray will drop some distance below the paper path, after the sheet has been discharged from the copier. The tray-pusher may be activated by movement of the copier carriage or by an appropriate gear-train connection to a pair of juxtaposed rolls, slightly spaced from each other, constructed and arranged so that one roll will cause the other roll to rotate only when a sheet of paper is disposed between the rolls as the sheet is discharged from the copier. The stack of trays may be re-set manually or by the movement of the copier carriage.

10 Claims, 12 Drawing Figures

33
35
37
38
34
46
24
39
43
23
25
26
44
100
101
102
32
30
29
45
27
31
28

DROP TRAY SORTER

BACKGROUND OF THE INVENTION

With the continued development of photocopy machines and the reduction in complexity and increase in performance, and also the reduction in cost of such machines, it has become desirable to provide a sheet-sorting mechanism to operate in cooperation with the photocopier, but which can be provided at low cost, either as an attachment to the copier or built into the copier itself.

Prior inventors have developed sorters which have separate motor mechanism to drive the sorter, but this only increases the cost of the sorter.

Other sorter designs which require an inter-connection with the drive mechanism of the photocopier generally need complicated and expensive apparatus to accomplish that end.

SUMMARY OF THE INVENTION

The sorter of the present invention includes a frame which is located directly adjacent the horizontal discharge path of the sheet of paper from a photocopier. The frame may be hung on the chassis of the photocopier, may be incorporated into the chassis itself, or may be supported on a table adjacent the copier. The frame also includes a support for a plurality of sheet-receiving trays disposed generally in horizontal alignment with the discharge opening of the photocopy machine.

The trays are supported in such a manner that the inboard end of the trays lie in a stack above the discharge path of the sheet as it leaves the copier, and the trays drop, one at a time, as a sheet of paper passes out of the photocopier and onto the tray which lies beneath the path of the sheet.

The inboard ends of the trays are moved by a tray-pusher which is actuated by movement of the copier-carriage, or by a plurality of shafts, rollers and gears which are caused to operate by the passage of the paper from the photocopy machine. In the latter arrangement, as the paper is gripped between a plurality of rollers, and as the paper moves between the rollers, the rollers turn and cause a gear-train mechanism to swing the pusher arm which moves the lower-most tray of the upper stack into a dropping position after the sheet has passed from between the rollers and into the lower-most sheet-receiving tray. The tray-dropping mechanism is motivated by the movement of the sheet of paper or by the copier-carriage, and thus there is no need for a separate expensive motor to drive the sorter.

After a series of sheets have passed into the sorter, and the sorting of those sheets has been accomplished, the trays can be reset to the upper-most stacking position by a hand-operated lever or by the action of the copier-cover.

The outboard end of the trays can be elevated manually by the operator to remove the sheets which have collected on their respective trays.

Thus the sorter of the present invention requires no complicated mechanism for its operation and can be inexpensively and easily constructed. It can be built into a copier or it can be made and sold independently of a copier machine for quick and easy attachment to the copier.

With the foregoing in mind a principal object of the present invention is to provide an inexpensive and uncomplicated sorter mechanism for photocopiers.

A further object of the present invention is to provide a sheet-sorter for photocopy machines, the sorting action of which is motivated by the paper which is discharged from the photocopy machine.

An additional object of the present invention is to provide a sheet-sorter for photocopy apparatus which can be easily and inexpensively attached to a photocopier and which requires no independent drive mechanism.

With the above and other objects in view, more information and understanding of the present invention may be achieved by reference to the following detailed description.

DETAILED DESCRIPTION

For the purpose of illustrating the invention, there is shown in the accompanying drawings a form thereof which is at present preferred, although it is to be understood that the various instrumentalities of which the invention consists can be variously arranged and organized and that the invention is not limited to the precise arrangements and organizations of the instrumentalities as herein shown and described.

In the drawings, wherein like reference characters indicate like parts:

FIG. 4 is a detailed view of one form of pusher mechanism.

Figure 1:
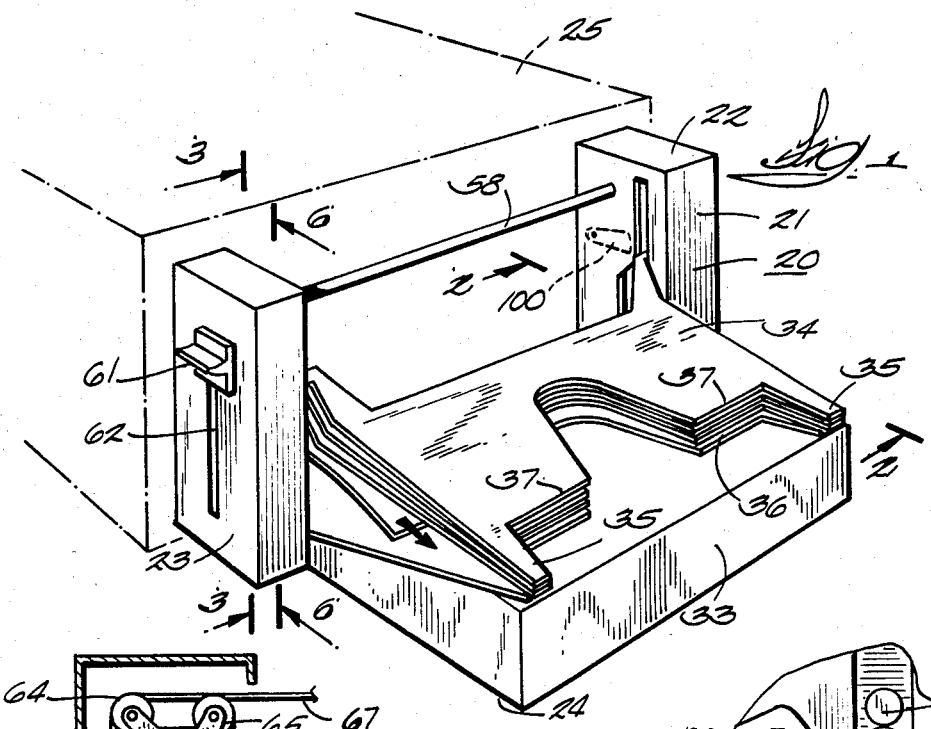
FIG. 1 is a perspective view of the drop tray sorter of the present invention shown as it can be attached to the discharge portion of a photocopying machine.
Figures 2, 12:
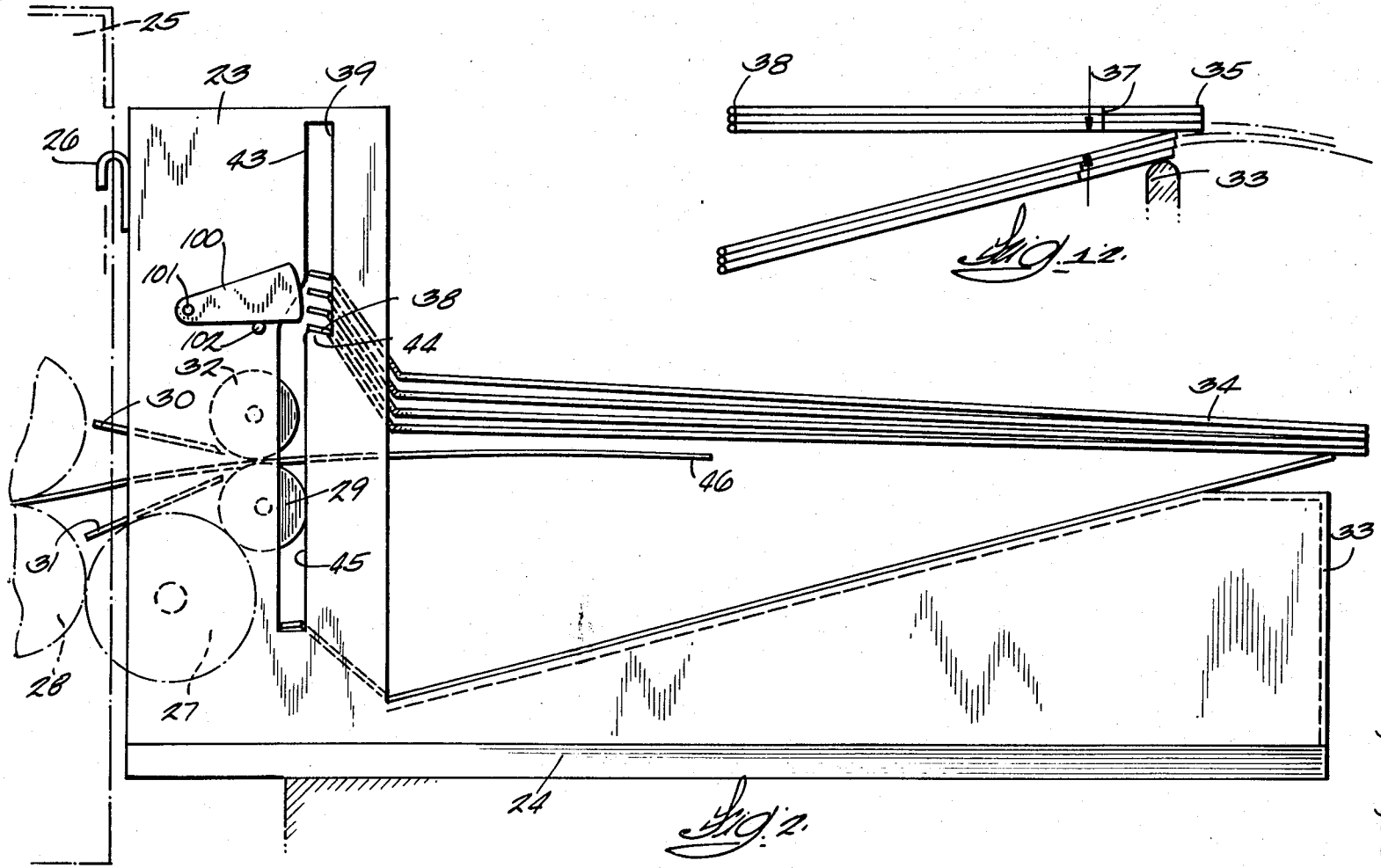
FIG. 2 is a vertical cross-sectional view taken generally along line 2—2 of FIG. 1.
FIG. 12 is a stylized side-elevational view of another form of tray-stacking arrangement.

In FIGS. 1 and 2, there is shown a sorter 20 which includes a frame 21 consisting of a pair of pillars 22 and 23 and a base portion 24. The pillars 22 and 23 are spaced a sufficient distance to accommodate a sheet of paper therebetween, and the base 24 supports them in upright position so that the sorter may be supported on a photocopy machine 25 by a pair of brackets 26 (or similar support).

Between the pillars 22 and 23, a friction drive 27 is supported so as to extend beyond the pillars and into contact with the copier exit roll 28. The friction drive is also in contact with the sorter lower drive roll 29, and when the copier exit roll rotates, as when a copy sheet is discharged from the copier, the friction drive contact therewith also causes the lower drive roll of the sorter to rotate.

It is to be understood that the lower drive roll may be independently driven by a motor and does not have to be in contact with the copier exit roll through the friction drive 27.

A plurality of paper guides 30 and 31 are disposed between the pillars 22 and 23 in alignment with the copier exit rolls so that the paper discharged from the copier exit rolls will be guided by the members 30 and 31 into position between the lower drive roll 29 and the upper drive roll 32 of the sorter.

The base 24 includes an end 33 against the top of which a plurality of paper trays 34 are supported at their outboard end as is shown particularly in FIG. 2. The main body-portion of each of the trays is flat, as shown in FIGS. 1 and 2. The end extensions 35 of the trays immediately above and below the paper-path pivot on each other causing a gap 36 to be created along the edges 37.

Figure 5:
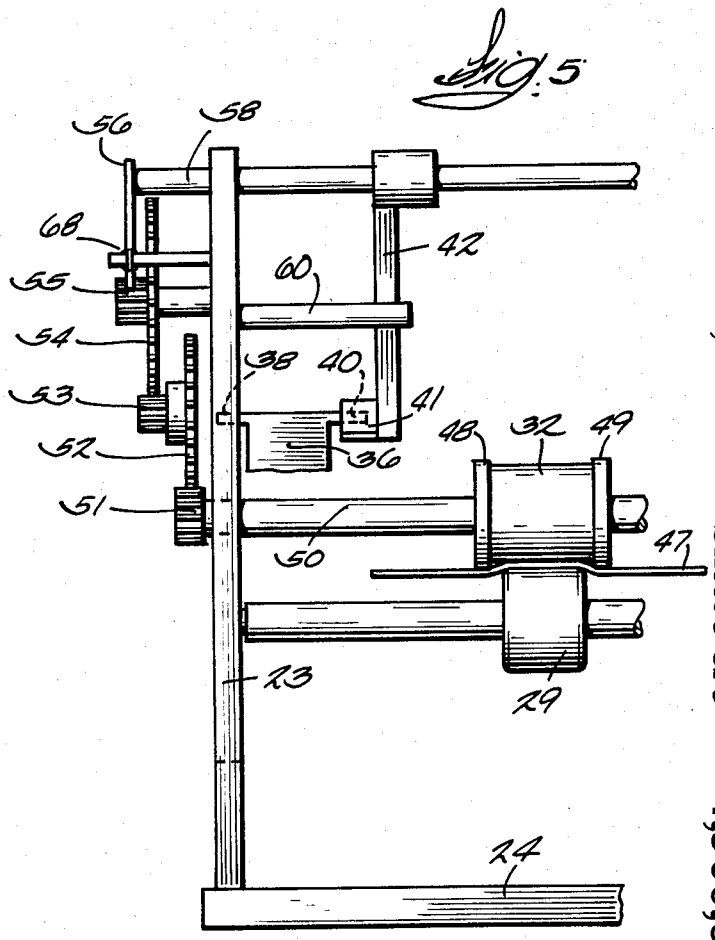
FIG. 5 is a stylized schematic view, in section, of the roller-drive and gear-train mechanism which operates the tray pusher of FIG. 4.

The inboard end of each tray as seen in FIGS. 2 and 5 includes a finger 38 arranged to travel in a slot 39 in the adjacent pillar (22 or 23). Another finger 40 extends in a direction opposite the finger 38 and is disposed in alignment with the finger 41 on the pusher 42.

The slot 39 includes an upper portion 43 in which the fingers 38 are guided. The finger 38 on the lower-most tray (of the trays stacked above the paper path) rests on a step 44 as is shown particularly in FIGS. 2 and 3.

A lower portion 45 of the slot 39 is offset horizontally from the portion 43 and the fingers 38 guide the trays down the slot 45 when the pusher 42 pushes the lower-most tray away from the support of the step 44.

Figure 10:
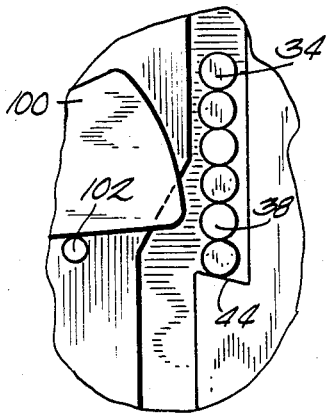
FIG. 10 is a detailed view of a control mechanism for the inboard-end of the trays.

Referring now to FIGS. 2 and 10, it is seen that pivot member 100 rotates about a pin 101 fixed in the side frame 23 and is prevented from falling by its stop 102. It allows the finger 38 resting on step 44 to be pushed to the left, but prevents the trays above from being also shifted to the left. When the trays are reset, the pivot members 48 engage the, member causing it to swing up out of the way. It may be spring-loaded, and there is one of them on each inboard side of the tray-stack.

The lower drive roll 29, when caused to rotate by the copy exit roll 28 and the friction drive 27, rotates freely beneath the upper drive roll 32 until a sheet of paper 47 passes between the rolls 29 and 32. These rolls may be cylindrical and closely spaced so that merely the thickness of a sheet of paper will cause the roll 29 to rotate the roll 32. Alternatively, as shown in FIG. 5, the upper drive roll may be spool-shaped with overhanging portions 48 and 49 which cause the sheet of paper 47 to be bent slightly and create greater friction between the rolls 29 and 32.

When the sheet of paper 47 is disposed between the rolls 29 and 32, the rotary movement of the lower drive roll 29 will cause the roll 32 and its connected shaft 50 to rotate, rotating the gear 51 attached to the end of the shaft 50.

Figure 3:
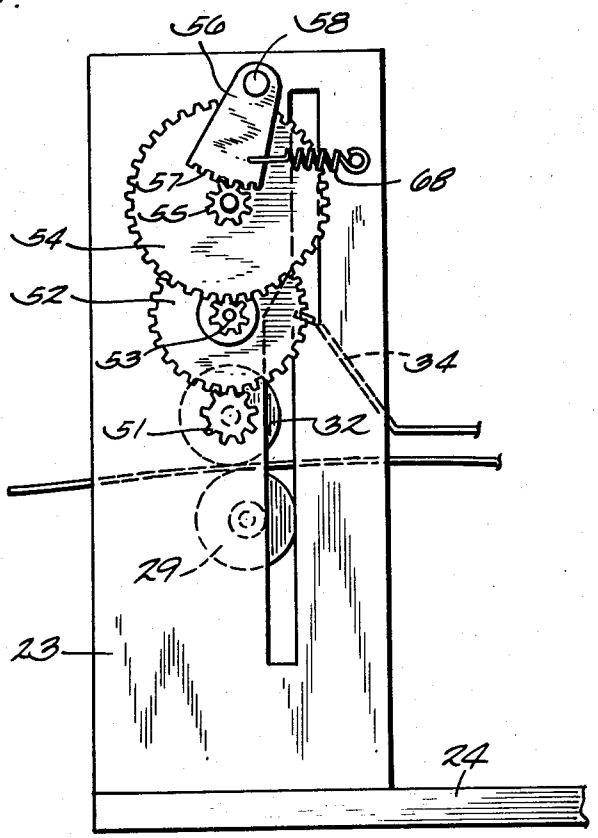
FIG. 3 is a vertical cross-sectional view of a gear-train mechanism taken generally along line 3—3 of FIG. 1.

Through appropriate gear train 52, 53, 54 and 55, the arm 56 with a gear segment 57 at its end is caused to pivot and turn the shaft 58. The tray pusher 42 shown in FIGS. 3, 4 and 5 is fastened to the shaft 58 and thus when the upper drive roll is turned (as previously described), the pusher 42 will swing in the direction of the arrow 59 shown in FIG. 4.

Under normal conditions, the pusher 42 is held against the stop 60, but when the action previously described causes the pusher to move in the direction of the arrow 59, the finger 41 on the pusher 42 engages a tray tab 38 or 40 from the lower-most tray of the stack of trays disposed above the paper path 46, causing that lower-most tray of the stack to be moved slightly to the left, as seen in FIG. 2, whereupon fingers 38 and 40 are pushed from the step 44 and the inboard end of the lower-most tray of the stack drops a short distance through the slot 39 (as guided by the portion 45) where is is caught by the step 69 of the pusher arm 42. It is held here, above the paper path 46, until the end of the paper has been transported through the rollers 29 and 32. When roller 32 is then free to rotate, the spring 68 pulls the arms back to stop 60, the gears and roller 32 spin back to their original position, and the tray drops to below the paper path 46 where it stacks at the bottom of the sorter (or upon the tray which immediately preceded it in the downward movement).

The action described above is repeated each time a sheet of paper is discharged from the copier and passes between the lower and upper drive rolls 29 and 32.

Figure 6:
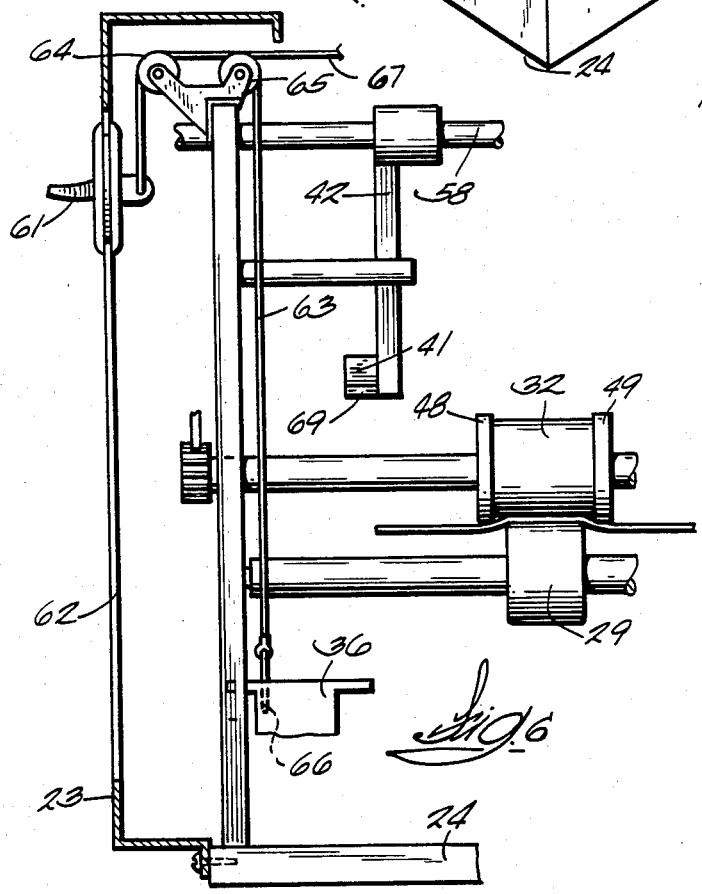
FIG. 6 is a schematic view of one form of reset mechanism taken generally along line 6—6 of FIG. 1.

Referring now to FIG. 6 there is shown one form of mechanism whereby the sorter can be reset when the original document is changed (i.e., after the number of duplicate copies has been made by the photocopy machine and placed into the respective trays in the sorter).

The handle 61 is guided in the slot 62 in the pillar 23. A cable 63 passes around pulley 64 and 65 and has one lower end 66 connected to the tab 36 on the lower-most moving tray. A second cable 67 passes across the sorter from pillar 23 to pillar 22 where its lower-most end is attached to the other tab at the other end of the lower-most tray.

When the handle 61 is pushed down in the slot 62, the cables 63 and 67 pull both sides of the lower-most moving tray (and all of the trays resting above that one) upwardly so that the tabs ride in the slots in the pillars.

When the handle 61 is at the lower-most end of its travel, the tabs on the lower-most moving tray drop into position on top of the step 44 in the upper portion 43 of the slot 39. When that lower-most moving tray is moved by the finger 42 so as to drop in the lower portion 45 of the slot 39, the handle is pulled by the cables to the upper-most end of the slot 62.

There is shown in FIG. 3 a spring 68 which biases the arm 56 and thus the finger 42 against the stop 60.

When the trailing edge of the sheet of paper clears the sorter feed rollers and drops into a tray, the upper feed roller, gears and pusher are returned home against the stop 60, as previously described.

Figure 11:
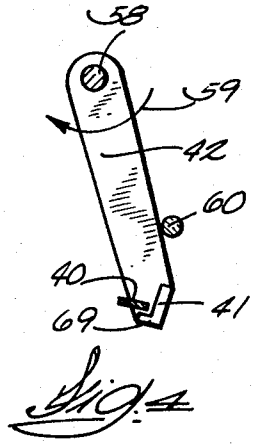
FIG. 11 is a plan view of one of the paper-trays.

With reference to the construction of the trays 34, it can be seen by reference to FIGS. 1, 2, 11 and 12 that the major portion of the trays are flat and lie closely stacked one upon the other. The inboard ends may be flat and straight as shown in FIGS. 11 and 12, or may be curved slightly to fit into the tray-guiding slots 39 as shown in FIG. 2. The fingers 38 and 40 may be rectangular as shown in FIG. 2, or may be circular in cross-section as shown in FIGS. 10, 11 and 12.

Figure 8:
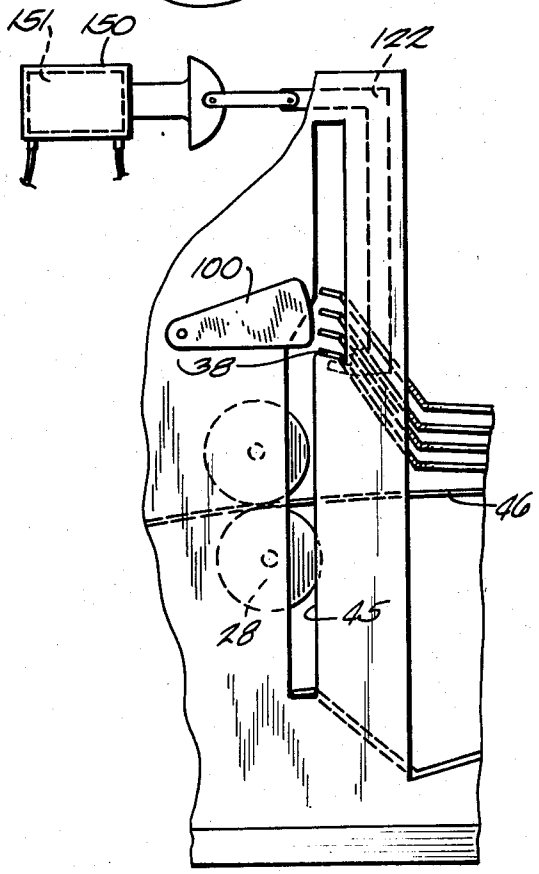
FIG. 8 is a stylized view of still another form of tray-pusher mechanism.
Figure 7:
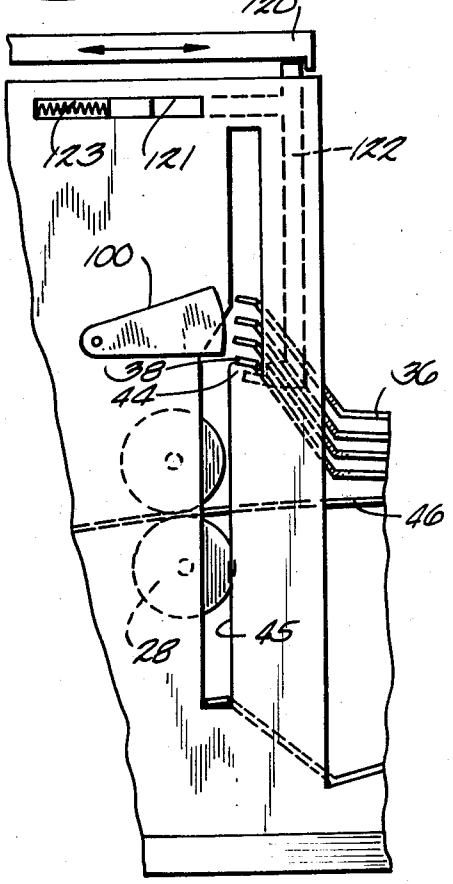
FIG. 7 is a cross-sectional view of another form of tray-pusher mechanism.

With reference to FIGS. 7 and 8, there is shown a modified form of tray-pusher which can be actuated by the mechanical movement of the copier-carriage (FIG. 7), or by the electric circuitry of the copier (FIG. 8). The arrangement shown in FIGS. 7 and 8 is particularly effective when the sorter mechanism is applied as an integral part of the copier.

FIG. 7 is similar to FIG. 2 but no wheels 27, 29 or 32 are needed because the copier-exit rolls 28 (and the one directly above it as shown in FIG. 2) serve that drivefunction. Neither are the gears 51–57 needed in this embodiment. Moving carriage 120 of the copier (or the moving optics of a fixed glass machine) is constructed and arranged to produce a copy as is well known in the art. At the end of its motion, the carriage strikes the tray-pusher 122 to push the tray end 38 off the step 44 and to hold it in that position. As the next copy is made and the carriage 120 moves to the right, the spring 123 slides the pusher 122 from the slot 121 to the right, and the tray with the tab 38 drops to a position below the paper path 46. This is before the paper reaches the sorter area.

In FIG. 8, there is illustrated a mechanism whereby a solenoid 150, connected by the coil 151 to the electrical components (not shown) of the copier, also operates the pusher 122 in a manner similar to that described above.

Figure 9:
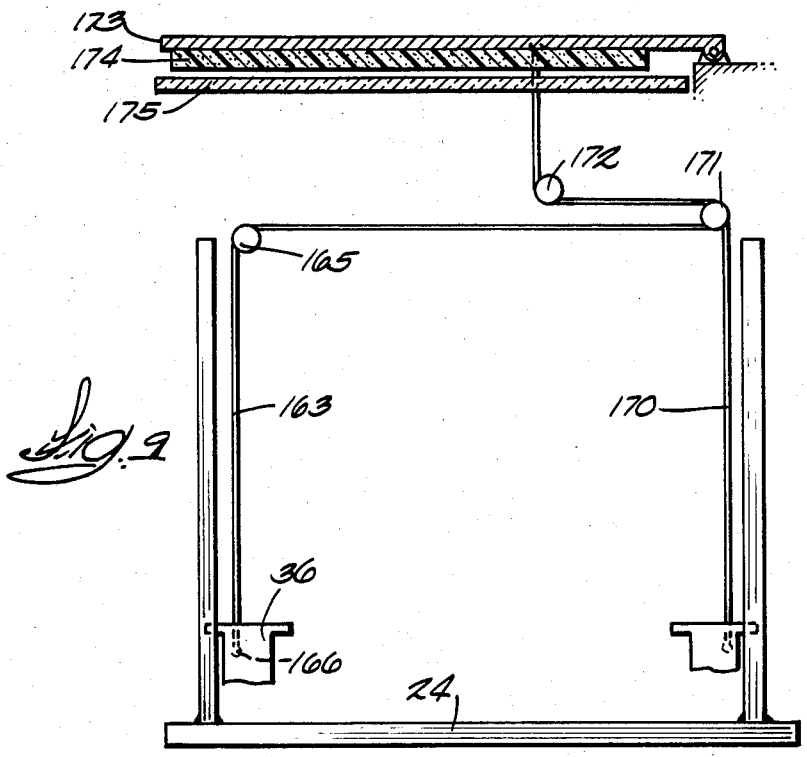
FIG. 9 is a schematic view of another form of reset mechanism.
Figure 11:
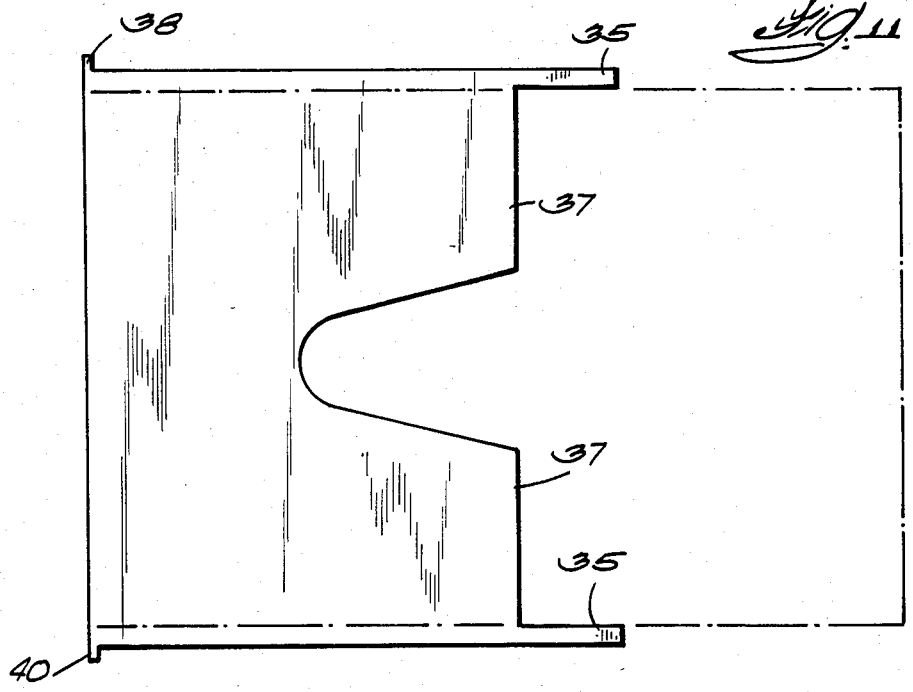

With reference to FIG. 9, there is shown a schematic arrangement whereby the tray-reset mechanism can be inter-connected to the copier machine so that when the cover of the copy machine is raised to change the original document, the trays can be reset to the upper position. This replaces the reset mechanism illustrated and described previously with regard to FIG. 6.

In FIG. 9, there is shown a cord 163 which is attached to the lower tray at 166 and passes over the pulley 165. On the right side of the drawing, the cord 170 is also attached to the tray. Both cords pass over pulleys 171 and 172, and are fixed to the platen cover 173 of the copier. Normally the platen cover has a soft white pad 174 which holds the original document against the copy glass 175.

When the platen cover is opened to change the original document, the trays are pulled up by the cords 163 and 170 so that the fingers 38 and 40 once again rest on the step 44 when ready for the next set of copies.

Any excess motion of the pusher 42 which may be caused by long paper is avoided by a friction clutch or similar device, such as having the roller 32 of a plastic with a lower coefficient of friction to paper than the rubber roller 29.

It is to be understood that the present invention may be embodied in other specific forms without departing from the spirit or special attributes hereof, and it is therefore desired that the present embodiments be considered in all respects as illustrative, and therefore not restrictive, reference being made to the appended claims rather than to the foregoing description to indicate the scope of the invention.

Having thus described my invention, what I claim as new and desire to protect by Letters Patent are the following:

1. In a sheet-sorter for a photocopier, which photocopier includes a carriage and a cover and which discharges a sheet along a path into said sorter, a plurality of trays, a frame to support said trays, the frame including vertical guides for the inboard end of each of said trays and a support for the outboard end of each of said trays, said trays having support portions extending into said guides, said vertical guide having upper and lower horizontally offset sections meeting at and forming a step in said frame engageable by said support portions to support the inboard ends of the trays above the sheet-path, a pusher to move the support portions of the lower-most tray in a stack of trays off said step, and a drive-mechanism to move said pusher into engagement with said support portions on said step when a sheet has passed from the photocopier into the sorter to move the support portions of said lower-most tray to the lower guide section.

2. The sorter of claim 1 wherein said drive-mechanism includes a pair a rolls including a drive roll and a driven roll, said driven roll being driven by a sheet passing between said rolls from the photocopier to the sorter.

3. The sorter of claim 1 wherein said drive-mechanism and said cover have portions engageable upon movement of said carriage in one direction to actuate said pusher to move said lower-most tray as aforesaid.

4. The sorter of claim 1 wherein said drive mechanism includes a solenoid connected to said pusher.

5. The sorter of claim 1 wherein the pusher has a finger to support the inboard end of a shifted tray.

6. The sorter of claim 2 wherein one of said drive rolls is cylindrical and the other is spool-shaped, the cylindrical roll being disposed parallel to the spool-shaped roll intermediate the ends thereof.

7. The sorter of claim 1 including lifter means to return the trays to stacked position above the sheet-path.

8. The sorter of claim 7 wherein the lifter is operatively connected to the cover of the copier to lift said tray upon raising of the copier cover.

9. The sorter of claim 7 wherein the lifter includes a hand-operated pusher.

10. The sorter of claim 1 wherein all of the trays are flat and disposed to lie in close contact with each other.

* * * * *